United States Patent [19]

Margen

[11] 4,102,134

[45] Jul. 25, 1978

[54] HOT WATER RESERVOIR

[75] Inventor: Peter Heinrich Erwin Margen, Nyköping, Sweden

[73] Assignee: Aktiebolaget Atomenergi, Stockholm, Sweden

[21] Appl. No.: 753,947

[22] Filed: Dec. 23, 1976

[30] Foreign Application Priority Data

Dec. 23, 1975 [SE] Sweden ..... 7514624

[51] Int. Cl.[2] ..... E02B 3/00

[52] U.S. Cl. ..... 61/1 F; 61/101; 114/293

[58] Field of Search ..... 61/1 R, 0.5, 1 F, 101; 114/293, 270; 9/8 R

[56] References Cited

U.S. PATENT DOCUMENTS

| | | | |
|---|---|---|---|
| 3,339,367 | 9/1967 | Lacy, Jr. | 61/101 |
| 3,517,513 | 6/1970 | Rensman et al. | 61/1 R |
| 3,630,033 | 12/1971 | Tuttle | 61/1 F |
| 3,640,073 | 2/1972 | Samsel | 61/1 F |
| 3,653,215 | 4/1972 | Crucet | 61/1 F |
| 3,839,870 | 10/1974 | Ryan | 61/1 F |

FOREIGN PATENT DOCUMENTS

| | | | |
|---|---|---|---|
| 777,644 | 6/1957 | United Kingdom | 61/0.5 |
| 816,440 | 7/1959 | United Kingdom | 61/101 |

*Primary Examiner*—Paul R. Gilliam
*Assistant Examiner*—Alexander Grosz
*Attorney, Agent, or Firm*—Burns, Doane, Swecker & Mathis

[57] ABSTRACT

A hot water reservoir comprises buoys floating on the surface of a lake, and a flexible wall fastened to said buoys hanging down into the water. Weights are fastened to the lower edge of said wall. Cables extend from the buoys to the weights so as to reinforce said flexible wall. The buoys are fastened to anchoring wires extending toward the interior of the reservoir.

8 Claims, 6 Drawing Figures

HOT WATER RESERVOIR

The invention relates to a hot water reservoir, for example a hot water reservoir for a district heating plant. Such a reservoir may be a comparatively small one, for absorbing the variations in heat consumption between night and day, or it may be an extremely large one, for absorbing the variations in heat consumption between summer and winter.

It is the object of the invention to provide a simple and inexpensive hot water reservoir by using a flexible wall for enclosing a limited portion of a natural or artificial lake, sea bay or other body of water. All these types of water bodies will be referred to as lakes in the following specification and claims.

The hot water reservoir of the invention comprises a plurality of buoys floating on the surface of a lake and enclosing a limited area of said lake, a substantially vertical wall of a flexible material having its upper edge fastened to said buoys, weights fastened to the lower edge of said wall to maintain the wall in its substantially vertical position, cables extending between the buoys and the weights to reinforce said wall, and anchoring wires extending from the buoys toward the interior of the reservoir.

In the hot water reservoir of the invention the surface of the hot water inside the reservoir will be at a level higher than that of the surface of the cold lake water outside the reservoir, because of the density difference. The higher water level inside the reservoir will result in an outwardly directed pressure on the wall of the reservoir. The difference in water levels inside and outside the reservoir is not great. In a reservoir having a depth of 10 meters and a temperature difference of 50° C with respect to the cold lake water the level difference will be approximately 1 decimeter. In a very large reservoir the internal pressure will create a very high tension in the wall of the reservoir unless precautions are taken. The reinforcing cables and the anchoring wires of the invention provide such precautions.

It is desired to reduce the loss of heat from the hot water body to the cold lake water and to the atmosphere. The loss of heat to the cold lake water is reduced by making the wall of the reservoir consist of two or more sheets substantially impervious to water and having stagnant water between them. They consist preferably of a web or fabric coated with a plastic which can resist the temperature of the hot water. The loss of heat to the atmosphere is reduced by placing a heat insulating sheet to float on the hot water surface. The material of the sheet is preferably a foamed plastic which may serve as a carrier for the water distribution pipes, as will be described below.

The invention will now be described with reference to the drawings.

Figure 1:
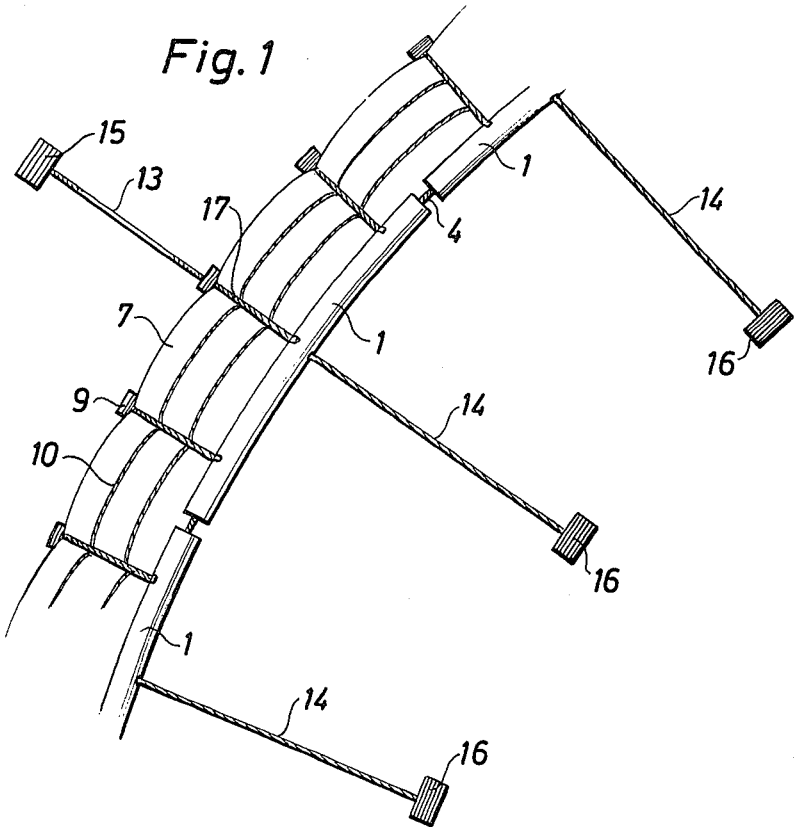
FIG. 1 is a top view of a portion of a reservoir of the invention.
Figure 2:
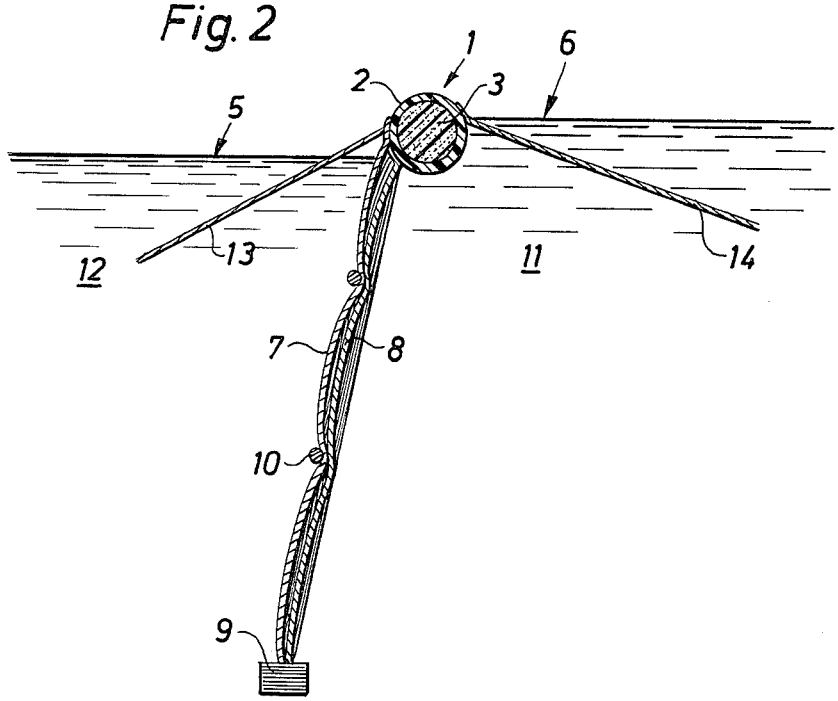
FIG. 2 shows a vertical cross-sectional view of the reservoir of FIG. 1.

The reservoir of FIGS. 1 and 2 contains a plurality of elongated buoys 1 enclosing a circular area of a lake. The buoys consist of a plastic tube 2 filled with a floatable material 3, such as a foamed plastic. Adjacent buoys are fastened to each other by joining members 4. A wall 7,8 has its upper edge fastened to the buoys. The lower edge of the wall carries weights 9 which keep the wall in a substantially vertical position in the lake. The wall consists of double sheets 7 and 8. Each sheet consists preferably of a fabric coated with a plastic, such as polyvinyl chloride, rendering the sheets substantially impervious to water. Between the sheets is a layer of stagnant water, which increases the heat-insulating capacity of the wall. Connection currents in the stagnant water can be reduced if a porous material, such as foamed plastic, is applied between the sheets 7 and 8. The pores of the porous material will be filled with water, and the convection in the water in the pores will be low.

Vertical cables 17 are arranged on the outside of the wall 7,8. The upper end of each cable is fastened to a buoy 1, the lower end to a weight 9. Two horizontal cables 10 extend along the outside of the wall 7,8. The cables 17 and 10 create a network which reinforces the wall 7,8 and makes it resist the internal pressure in the hot water reservoir. This internal pressure results from the fact that the hot water surface 6 inside the reservoir is higher than the cold water surface 5 outside the reservoir. The difference in water levels is due to the fact that the density of the hot water is lower than that of the cold water. Buoys 1 must be high enough to cover the difference in water levels. Because of the internal pressure in the reservoir, wall 7,8 does not hang exactly vertically from the buoys.

The internal pressure inside the reservoir is absorbed by main anchoring wires 14, extending substantially towards the center of the reservoir. One end of each wire is fastened to a buoy 1, and the other end is fastened to a main anchoring weight 16 positioned on the bottom of the lake. In the illustrated embodiment each buoy 1 is fastened to one wire 14. If desired, two or more wires 14 may be fastened to each buoy. The tensile strength of the wires 14 should preferably be high enough to make these wires absorb the entire force created by the internal pressure in the reservoir. If not, undesired tensional forces will be created in the buoys 1 and the joining members 4.

Buoys 1 are also fastened to auxiliary anchoring wires 13 extending outwardly from the reservoir and fastened to auxiliary anchoring weights 15 positioned on the bottom of the lake. There is preferably at least one wire 13 for each buoy. These auxiliary wires 13 make the reservoir resist forces created by the wind and by currents in the lake.

Figure 3:
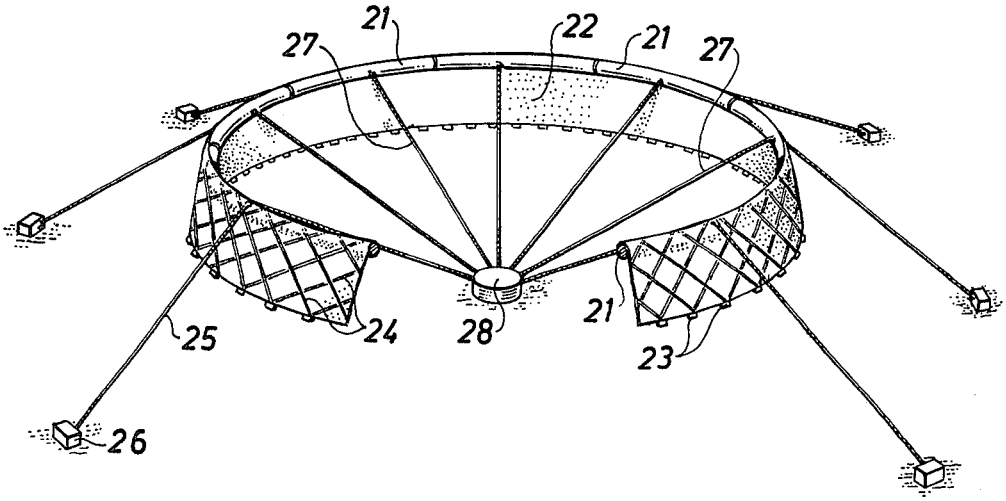
FIG. 3 is a perspective view of a second embodiment of the invention.

The hot water reservoir of FIG. 3 comprises a plurality of elongated buoys 21 creating an annular member, and a flexible wall 22 hanging down into the water from said buoy. Weights 23 are fastened to the lower edge of the wall 22. Cables 24 extend on the outside of the wall 22 to connect the buoys 21 with the weights 23. There are two sets of cables 24, the cables of one set crossing the cables of the other set. Consequently, the cables form a network reinforcing the wall 22. The buoys 21 are fastened to one end of main anchoring wires 27 which have their other end fastened to a single main anchoring weight 28 situated on the bottom of the lake below the center of the reservoir. The buoys 21 are also fastened to one end of auxiliary anchoring wires 25 which have their other ends fastened to individual auxiliary anchoring weights 26.

Figure 4:
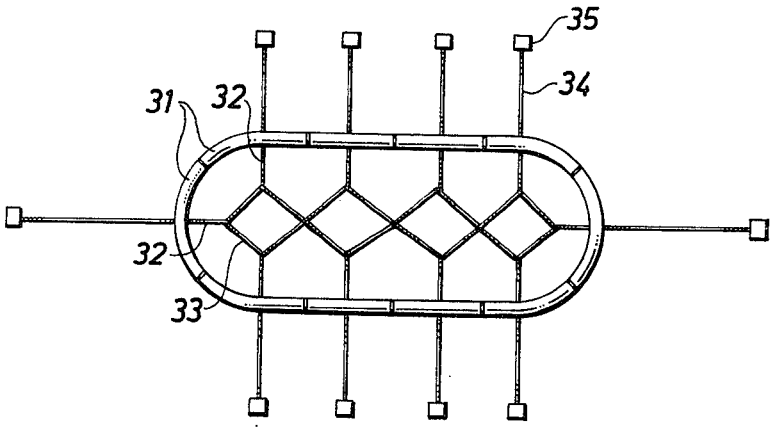
FIG. 4 is a top view of a third embodiment of the invention.

The hot water reservoir shown in FIG. 4 is of an elongated shape, and comprises a plurality of elongated buoys 31 fastened to wires 32. Wires 32 are not fastened to anchoring weights, as is the case in the embodiments of FIGS. 1 - 3, but they are interconnected by means of a system of auxiliary wires 33. Buoys 31 are also fastened to one end of anchoring wires 34 which have their other ends fastened to anchoring weights 35 positioned on the bottom of the lake. The side wall of the reservoir may be of the type illustrated by FIG. 2.

Figure 5:
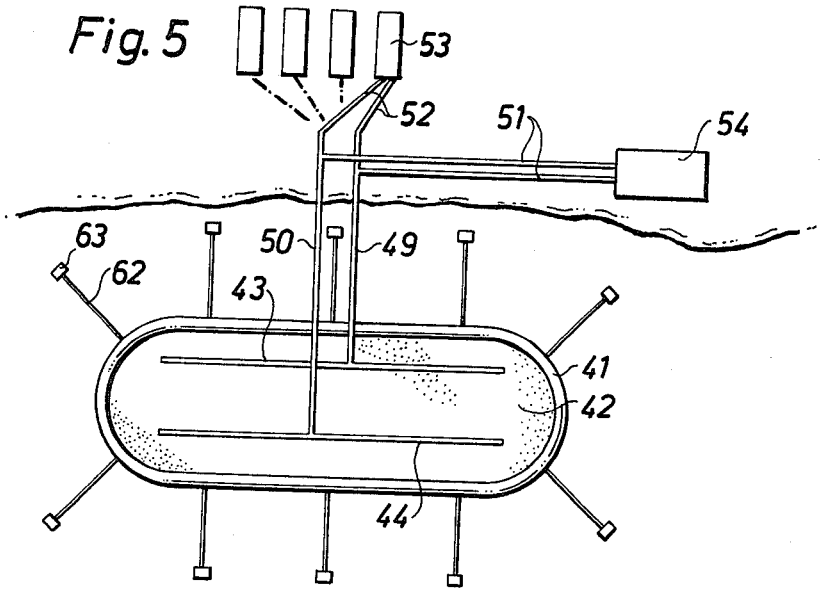
FIG. 5 is a top view of a fourth embodiment of the invention.
Figure 6:
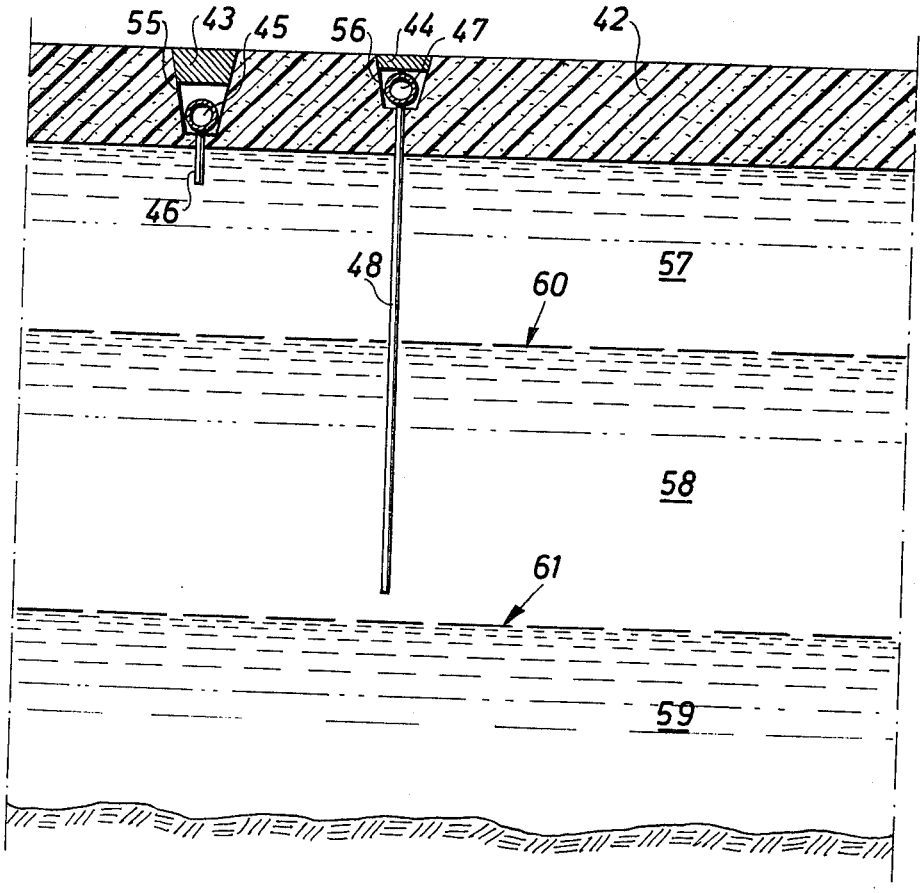
FIG. 6 is a vertical cross-sectional view on a larger scale of the reservoir of FIG. 5.

The hot water reservoir illustrated by FIGS. 5 and 6 comprises elongated buoys 41 enclosing an area of an elongated shape. The buoys are fastened to main anchoring wires, not visible, and to one end of auxiliary anchoring wires 62 which have their ends fastened to anchoring weights 63. The side wall of the reservoir may be of the type illustrated by FIG. 2. Referring to FIG. 6, the reservoir is seen to contain an upper layer 57 of hot water, for example, at 85° C, and a lower layer 58 of colder water, for example, at 45° C. Layers 57 and 58 are separated by different densities along an interface 60. Layer 58 has an interface 61 with the cold water body 59 of the lake. The level of the interface 61 is usually defined by the lower edge of the side wall of the reservoir. The hot water surface inside the buoys 41 is covered by a sheet 42 of floatable material, such as a foamed plastic which is preferably in the form of a plurality of plates having, for example, a square or hexagonal configuration. The sheet 42 provides heat insulation and prevents evaporation of the hot water in the reservoir. The upper surface of sheet 42 is provided with grooves 55, 56 for water distribution pipes 45,47. Grooves 55 for the hot water distribution pipes 45 are comparatively deep, and are closed by insulation plugs 43. Grooves 56 for the colder water distribution pipes 47 are comparatively shallow, and are closed by insulation plugs 44. Because of the different depths of the grooves 55,56 the pipes 45 and 47 can cross without interfering with each other. A plurality of branch pipes 46 extends from the hot water distribution pipes 45 down into the hot water layer 57. These branch pipes 46 are short, and their lower ends are situated in the upper portion of the hot water layer 57. A plurality of longer branch pipes 48 extends from the colder water distribution pipes 47 down to a level near the interface 61 with the cold lake water body 59.

Distribution pipes 45, 47 communicate through pipes 49 and 52 with building 53 to be heated, and through pipes 49 and 51 with a heat supply plant 54. This plant may be a power station, or it may be any industrial plant which produces waste heat.

The hot water reservoir illustrated in FIGS. 5 and 6 operates as follows. In the summer, when the heat consumption in the buildings 53 is low, colder water from the layer 58 is pumped through the pipes 48, 47, 49 and 51 to the heat supply plant 54. The water is heated in the heat supply plant, and is pumped through the pipes 51, 49, 45 and 46 to the hot water layer 54. Consequently, the interface 60 will sink. In the winter hot water from the hot water layer 57 will be pumped through the pipes 46, 45, 49 and 52, and the return water from the buildings will be pumped through the pipes 52, 49, 47 and 48 to the colder water layer 58. Consequently, the interface 60 will rise.

What is claimed is:

1. A hot water reservoir comprising:

a plurality of buoys floating on the surface of a body of water and enclosing a limited area thereof;

a substantially vertical wall of at least two sheets of flexible material impervious to water, said sheets fastened at their upper ends to said buoys and having stagnant water therebetween;

weights fastened to the lower edge of said wall to maintain the wall in its substantially vertical position;

cables extending between the buoys and the weights to reinforce said wall;

anchoring wires extending from the buoys toward the interior of the reservoir adapted to neutralize the tension on the wall of the reservoir caused by the difference in level between the hot water inside the reservoir and the cold water outside the reservoir; and a floatable sheet operatively disposed on the hot water surface to reduce evaporation and loss of heat from the hot water.

2. A hot water reservoir as claimed in claim 1, further including distribution pipes for carrying water to and from the reservoir mounted on said floatable sheet.

3. A hot water reservoir as claimed in claim 1, in which each anchoring wire is fastened to a separate anchoring weight placed on the bottom of the lake.

4. A hot water reservoir as claimed in claim 1, in which all anchoring wires are fastened to a common anchoring weight placed on the bottom of the lake.

5. A hot water reservoir as claimed in claim 1, in which all anchoring wires are interconnected.

6. A hot water reservoir as claimed in claim 1, in which a water-soaked porous material is placed between the sheets.

7. A hot water reservoir as claimed in claim 1, in which the buoys are also fastened to auxiliary anchoring wires extending outwardly from the reservoir and being fastened to auxiliary anchoring weights placed on the bottom of the lake.

8. An apparatus for enclosing a portion of a body of water having components adapted to be assembled in the field for providing a hot water reservoir comprising:

a plurality of buoy means adapted for floating on the surface of a body of water and for enclosing a limited area thereof;

a wall adapted to be disposed substantially vertically and having at least two sheets of flexible material impervious to water, said sheets adapted to be fastened at their upper ends to said buoy means and to have stagnant water disposed therebetween;

weights adapted to be fastened to the lower edge of said wall to maintain the wall in its substantially vertical position;

cables adapted to extend between the buoy means and the weights to reinforce said wall;

anchoring wires adapted to be extended from the buoy means toward the interior of the reservoir, adapted to neutralize the tension on the wall of the reservoir caused by the difference in level between the hot water inside the reservoir and the cold water outside the reservoir; and, a floatable sheet adapted to be disposed on the hot water surface to reduce evaporation and loss of heat from the hot water.

* * * * *